US008191195B2

(12) United States Patent
Nelson

(10) Patent No.: US 8,191,195 B2
(45) Date of Patent: Jun. 5, 2012

(54) SCRATCH AND DISPOSE APPARATUS

(76) Inventor: Donald W. Nelson, Murrysville, PA (US)

( * ) Notice: Subject to any disclaimer, the term of this patent is extended or adjusted under 35 U.S.C. 154(b) by 168 days.

(21) Appl. No.: 12/497,769

(22) Filed: Jul. 6, 2009

(65) Prior Publication Data

US 2010/0064458 A1 Mar. 18, 2010

Related U.S. Application Data

(60) Provisional application No. 61/096,467, filed on Sep. 12, 2008.

(51) Int. Cl.
*B08B 7/00* (2006.01)

(52) U.S. Cl. ..... 15/111; 15/77; 15/88.3; 15/93.1; 15/93.4; 15/102

(58) Field of Classification Search ..... 15/104.095, 15/111, 236.01, 77, 102, 88.3, 93.1, 93.4
See application file for complete search history.

(56) References Cited

U.S. PATENT DOCUMENTS

| | | | | |
|---|---|---|---|---|
| 4,765,842 | A * | 8/1988 | Sanders et al. | 134/9 |
| 4,777,693 | A * | 10/1988 | Diba et al. | 15/236.01 |
| 4,927,148 | A | 5/1990 | Weiner | |
| 5,127,720 | A * | 7/1992 | Shultz | 312/229 |
| 5,253,383 | A * | 10/1993 | Clark | 15/88.3 |
| 5,367,959 | A * | 11/1994 | Allen et al. | 108/23 |
| 6,032,995 | A * | 3/2000 | Barbaro | 294/1.4 |
| 2006/0220311 | A1 | 10/2006 | Campbell | |

* cited by examiner

*Primary Examiner* — Robert Scruggs
(74) *Attorney, Agent, or Firm* — Aidenbaum Schloff and Bloom PLLC; Jay Schloff

(57) ABSTRACT

An apparatus for scratching and disposing a scratch-off coating that conceals information on a paper is provided. The apparatus includes a panel, one or more scratch tools, a brush and a debris unit. The panel includes a base and a plurality of walls. The plurality of walls is configured along a periphery of the base to form an enclosed area therebetween for accommodating the paper. The paper is accommodated within the enclosed area, and the scratch-off coating is scratched using the one or more scratch tools. The one or more scratch tools are capable of being contained within the panel. Scratching the scratch-off coating forms debris. The debris formed is swept using a brush. The brush is capable of being contained within the panel. The swept debris is received and contained in the debris unit that is coupled to a first wall of the plurality of walls.

10 Claims, 6 Drawing Sheets

SCRATCH AND DISPOSE APPARATUS

CROSS-REFERENCE TO RELATED APPLICATIONS

The present disclosure claims priority under 35 United States Code, Section 119 on the U.S. Provisional Patent Application No. 61/096,467 filed on Sep. 12, 2008, the disclosure of which is incorporated by reference.

FIELD OF THE DISCLOSURE

The present disclosure relates generally to scratching a scratch-off coating from a paper, and, more particularly, to an apparatus for scratching and disposing a scratch-off coating.

BACKGROUND OF THE DISCLOSURE

Certain games, such as a lottery, are based on random generation of a sequence of alphanumeric characters, usually numbers. Each player of such a game is provided with a paper, such as a lottery ticket, a scratch card, and the like, that includes alphanumeric characters concealed under a scratch-off coating. A player wins the game when the alphanumeric characters on the player's paper match the generated sequence of alphanumeric characters. The alphanumeric characters on the paper are revealed to the player upon scratching the scratch-off coating from the paper. A tool, such as a coin, a blade, and the like, may be used by the player for scratching the scratch-off coating from the paper.

Generally, such games are offered at busy places, such as gas stations, convenience stores, and the like. The player may receive the paper at such a place and may need to scratch the coating from the paper using the tool. Specifically, the player may be seated in his vehicle while scratching the coating from the paper. Debris, such as shreds of the scratch-off coating, dust, and the like, is formed when the player scratches the scratch-off coating from the paper.

The above mentioned technique of scratching the scratch-off coating may be inconvenient for the player. Specifically, it may be inconvenient for the player to scratch the scratch-off coating from the paper seated in the vehicle. Further, the vehicle may provide an uneven surface to the player for placing the paper while scratching the coating. The paper may tear when the paper is placed on the uneven surface of the vehicle during the scratching. Furthermore, a tool needed for scratching the scratch-off coating from the paper may be unavailable to the player in the vehicle.

Still further, the debris formed by scratching the scratch-off coating may cause a surrounding area, such as the vehicle or any other area where the player scratches the scratch-off coating, to become messy. Yet further, the player may need to clear the debris from the paper by using his bare hands, thereby dirtying his hands.

In light of the drawbacks mentioned above, there exists a need for providing convenience to a player while scratching a scratch-off coating from a paper. Specifically, there exists a need for a surface where a paper may be placed for scratching a scratch-off coating, with ease. Further, there exists a need for easing availability of a tool for the player to scratch the scratch-off coating. Furthermore, there exists a need for clearing debris that remains on a paper without dirtying a player's hands. Still further, there exists a need for disposing debris produced by scratching a scratch-off coating from a paper.

SUMMARY OF THE DISCLOSURE

In view of the foregoing disadvantages inherent in the prior art, the general purpose of the present disclosure is to provide an apparatus for scratching and disposing a scratch-off coating, configured to include all the advantages of the prior art, and to overcome the drawbacks inherent therein.

Accordingly, an object of the present disclosure is to provide an apparatus on which a paper may be placed for scratching a scratch-off coating from the paper, with ease.

Another object of the present disclosure is to provide an apparatus for disposing of debris produced in the scratching a scratch-off coating from a paper.

Yet another object of the present disclosure is to ease availability of a tool for a user, to enable the user to scratch a scratch-off coating from a paper.

Still another object of the present disclosure is to clear off debris by precluding use of hands by a user.

In light of the above objects, in one aspect of the present disclosure, an apparatus for scratching and disposing a scratch-off coating from a paper is provided. The scratch-off coating conceals information on the paper. The apparatus includes a panel, one or more scratch tools, a brush and a debris unit. The panel includes a base and a plurality of walls. The plurality of walls is configured along a periphery of the base to form an enclosed area therebetween for accommodating the paper. The one or more scratch tools are utilized for scratching the scratch-off coating from the paper accommodated within the enclosed area of the panel. Scratching the scratch-off coating forms debris. The one or more scratch tools utilized for scratching the scratch-off coating are capable of being contained within the panel. The brush is utilized for sweeping the debris formed by scratching the scratch-off coating. The brush is capable of being contained within the panel. The debris unit is coupled to a first wall of the plurality of walls of the panel for receiving and containing the debris formed by scratching the scratch-off coating.

The debris unit of the apparatus of the present disclosure enables disposal of the debris. Further, the enclosed area of the panel provides a suitable space for the paper to be accommodated for scratching the scratch-off coating, with ease. Furthermore, the one or more scratch tools provided with the apparatus ease availability of a scratch tool for scratching the scratch-off coating. Still further, the brush provided with the apparatus precludes a user from using his hands for clearing off the debris.

This together with other aspects of the present disclosure, along with the various features of novelty that characterize the present disclosure, are pointed out with particularity in the claims annexed hereto and form a part of this present disclosure. For a better understanding of the present disclosure, its operating advantages, and the specific objects attained by its uses, reference should be made to the accompanying drawing and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The exemplary embodiments described herein detail for illustrative purposes are subject to many variations in composition, structure, and design. It should be emphasized, however, that the present disclosure is not limited to a particular apparatus for scratching and disposing a scratch-off coating, as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms "a" and "an" herein do not denote a limitation of quantity, but rather denote the presence of at least one of the referenced items. The terms "first," "second," and the like, herein do not denote any order, quantity, or importance, but rather are used to distinguish one element from another.

The present disclosure provides an apparatus for scratching and disposing a scratch-off coating from a paper, such as a lottery ticket, a scratch card, and the like. The scratch-off coating present on the paper conceals information, such as alphanumeric characters, symbols, and the like, present therebetween. The apparatus enables containment of debris formed by scratching the scratch-off coating from the paper. Further, the apparatus provides an enclosed area for accommodating the paper for scratching the scratch-off coating from the paper, with ease. Furthermore, the apparatus provides one or more scratch tools for enabling a user to scratch the scratch-off coating from the paper, when required. The apparatus may be kept in a variety of locations, such as a vehicle, a room, and the like, to enable the user to easily access the apparatus.

Figure 1:
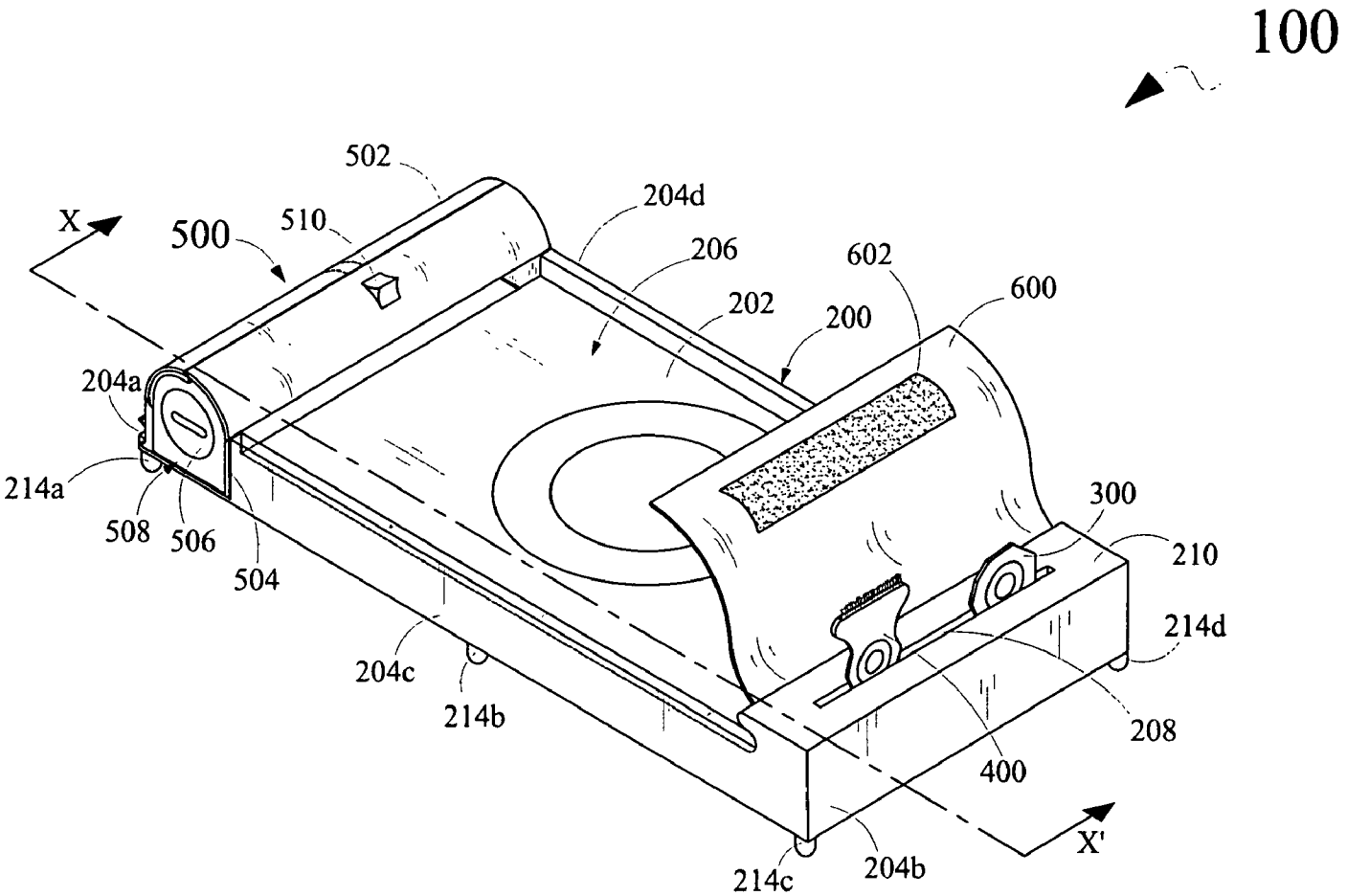
FIG. 1 illustrates a perspective view of an apparatus for scratching and disposing a scratch-off coating, in accordance with an embodiment of the present disclosure.

FIG. 1 illustrates a perspective view of an apparatus 100 for scratching and disposing a scratch-off coating 602 from a paper 600, in accordance with an embodiment of the present disclosure. The scratch-off coating 602 covers a portion of the paper 600 to conceal information present therebetween. Examples of the paper 600 include a lottery ticket, a scratch-off card, and the like. Examples of the information include alphanumeric characters, symbols, and the like. Scratching the scratch-off coating 602 from the paper 600 using the apparatus 100 reveals the information to a user.

The apparatus 100 includes a panel 200, one or more scratch tools, such as a scratch tool 300, a brush and scratch tool combination 400 and a debris unit 500. The panel 200 includes a base 202, a plurality of walls, such as a first wall 204*a*, a second wall 204*b*, a third wall 204*c* and a fourth wall 204*d* (the plurality of walls will hereinafter collectively be referred to as 'plurality of walls 204') and a plurality of feet, such as a foot 214*a*, a foot 214*b*, a foot 214*c*, a foot 214*d*, a foot 214*e* (not shown), and a foot 214*f* (not shown). The plurality of feet will hereinafter collectively be referred to as 'plurality of feet 214'. The foot 214*a*, the foot 214*c* and the foot 214*d* are configured on undersides of corner portions of the panel 200, as depicted in FIG. 1. The foot 216*d* is configured on an underside of a corner portion formed between the first wall 204*a* and the fourth wall 204*d*. Further, the foot 214*b* is configured on an underside of a middle portion of the third wall 204*c*, as depicted. Similarly, the foot 214*e* is configured on an underside of a middle portion of the fourth wall 204*d*. The plurality feet 214 may be dome-shaped and may be made of a shock absorbent material, such as rubber.

The base 202 may include a design, a logo, and the like, printed thereon. The plurality of walls 204 is configured along a periphery (not shown) of the base 202 to form an enclosed area 206 therebetween. The enclosed area 206 is capable of accommodating the paper 600 for scratching the scratch-off coating 602 therefrom. The coating 602 may be scratched by the user using the scratch tool 300. The scratch tool 300 is capable of being contained within a first slot 208 formed within the second wall 204*b* of the plurality of walls 204. It will be apparent to a person skilled in the art that the first slot 208 may be capable of containing the scratch tool 300 may be formed within another wall, such as the third wall 204*c* or the fourth wall 204*d*, of the plurality of walls 204. Further, the first slot 208 may be capable of containing the one or more scratch tools therewithin.

Specifically, the first slot 208 may be formed within an extension 210 of the second wall 204*b* of the plurality of walls 204. The extension 210 extends horizontally from the second wall 204*b* towards the enclosed area 206 of the panel 200, and covers a portion of the base 202 of the panel 200 to form a second slot (not shown). The second slot grips the paper 600 accommodated within the enclosed area 206. The second slot will be explained in more detail in FIG. 2.

The scratch-off coating 602 may be scratched from the paper 600 when the paper 600 is gripped in the second slot. The scratch-off coating 602 may be scratched by the user by utilizing a scratch tool, such as the scratch tool 300, of the one or more scratch tools. Scratching the scratch-off coating 602 forms debris (not shown). The debris refers to shreds of the scratch-off coating 602, dust, and the like. The debris formed may be swept by the user using the brush and scratch tool combination 400.

The brush and scratch tool combination 400 is capable of being contained within the panel 200. More specifically, the brush and scratch tool combination 400 may be contained in the first slot 208 of the second wall 204*b*. The brush and scratch tool combination 400 may be utilized for sweeping the debris into the debris unit 500. The debris unit 500 is coupled to the first wall 204*a* of the plurality of walls 204 of the panel 200. The debris unit 500 is capable of receiving and containing the debris formed by scratching the scratch-off coating 602. The debris unit 500 includes a door 502 and a housing 504. As depicted in FIG. 1, the debris unit 500 is semi-cylindrical in shape. However, it will be apparent to a person skilled in the art that the debris unit 500 may be of any other shape.

As depicted in FIG. 1, the door 502 is coupled to the housing 504. More specifically, the door 502 is molded with the housing 504 of the debris unit 500. However, it will be apparent to a person skilled in the art that the door 502 may be coupled to the housing 504 by any other coupling mechanism known in the art. The housing 504 is capable of receiving and containing the debris. The door 502 includes a first grip 510 configured on a center portion of the door 502. The first grip 510 is configured to enable opening and closing of the door 502. In an embodiment of the present disclosure, a pair of grips similar to the first grip 510 may be configured on side portions of the door 502. The debris unit 500 further includes a disposal lid 506. The disposal lid 506 is coupled to the housing 504 of the debris unit 500 at a first side portion 508 of the debris unit 500. Specifically, the disposal lid 506 is coupled to the housing 504 with a nut and bolt arrangement. The disposal lid 506 may be uncoupled from the housing 504 to remove contained debris from the debris unit 500.

In an embodiment of the present disclosure, the panel 200 of the apparatus 100 may have a width of about 5 inches. Further, the plurality of walls 204 of the panel 200 may have a height of about 1.125 inches. In one embodiment of the present disclosure, the base 202 may have a uniform thickness dimension, for example, 0.625 inches, throughout. In another embodiment of the present disclosure, the base 202 of the panel 200 may be configured with a slope that declines towards the debris unit 500. Specifically, a first end portion of the base 202 may have a thickness of 0.5 inches, and a second end portion of the base 202 may have a thickness of 0.75 inches. The thickness dimension of the first end portion and second end portion set forth herein are exemplary and should not be construed as limiting. The first end portion is proximal to the debris unit 500 and the second end portion is opposite to the first end portion. In another embodiment of the present disclosure, the plurality of walls 204 may extend about 0.25 inches above the base 202. The height of the extension of the walls 204 above the base 202 set forth herein is exemplary and should not be construed as limiting. Further, the apparatus 100 may have a length of about 10 inches. In yet another embodiment of the present disclosure, the first slot 208 may have dimensions of about 0.0625×0.375×4.125 inches. It will be apparent to a person skilled in the art that dimensions of the panel 200, the plurality of walls 204, the debris unit 500 and the first slot 208, may vary.

Figure 2:
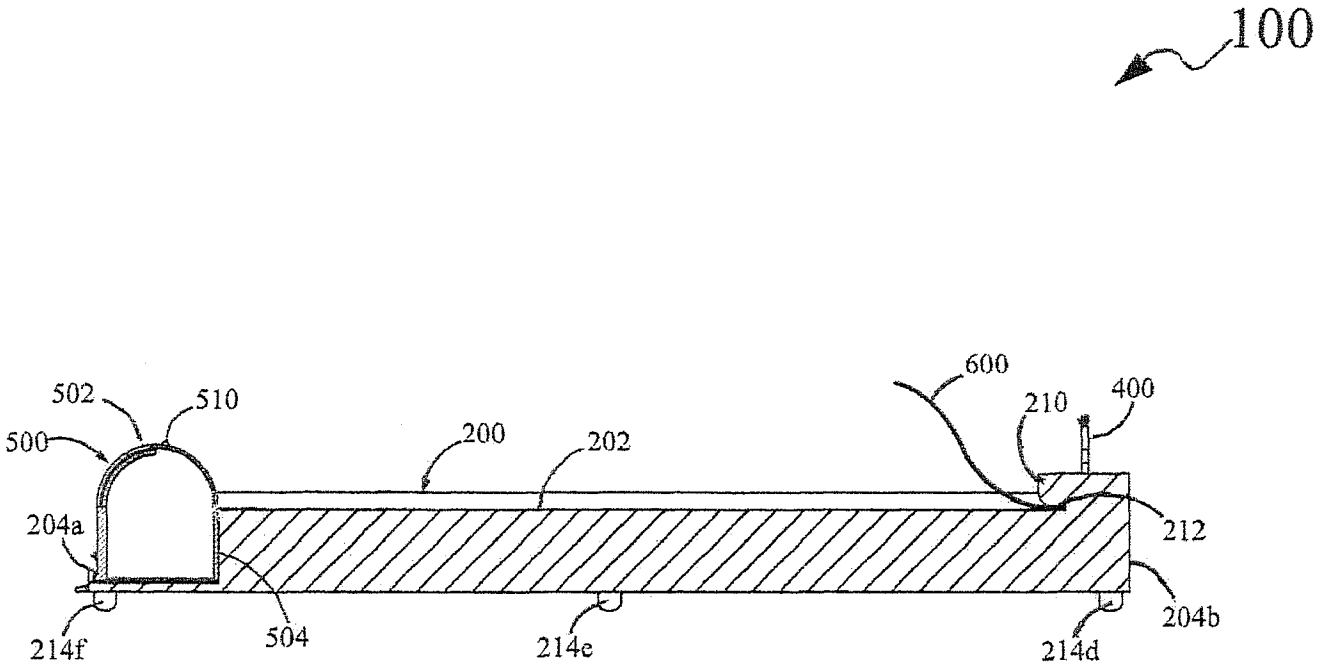
FIG. 2 illustrates a cross-sectional view of the apparatus of FIG. 1, in accordance with an embodiment of the present disclosure.

Scratching the scratch-off coating 602 from the paper 600 accommodated within the enclosed area 206 is explained in FIG. 2.

FIG. 2 illustrates a cross-sectional view of the apparatus 100 of FIG. 1 cross-sectioned along X-X' (as depicted in FIG. 1), in accordance with an embodiment of the present disclosure. The extension 210 of the second wall 204*b* of the plurality of walls 204 is configured to grip a portion of the paper 600. As depicted in FIG. 2, the extension 210 is configured to form a second slot 212 in conjunction with a portion of the base 202 of the panel 200. The portion of the paper 600 is slid into the second slot 212 to grip the portion of the paper 600 in the second slot 212 for enabling the paper 600 to remain steady when the scratch-off coating 602 is scratched from the paper 600.

Thereafter, the paper 600 is accommodated within the enclosed area 206 of the panel 200. It will be apparent to a person skilled in the art that though the second slot 212 is configured at the second wall 204*b* of the plurality of walls 204, any other wall of the plurality of walls 204 may be configured to form the second slot 212. Further, any other gripping mechanism may be utilized for gripping the portion of the paper 600 to enable the paper 600 to remain steady while scratching the scratch-off coating 602. The disposal of debris formed by scratching the scratch-off coating 602 is explained in FIG. 3.

Figure 3A:
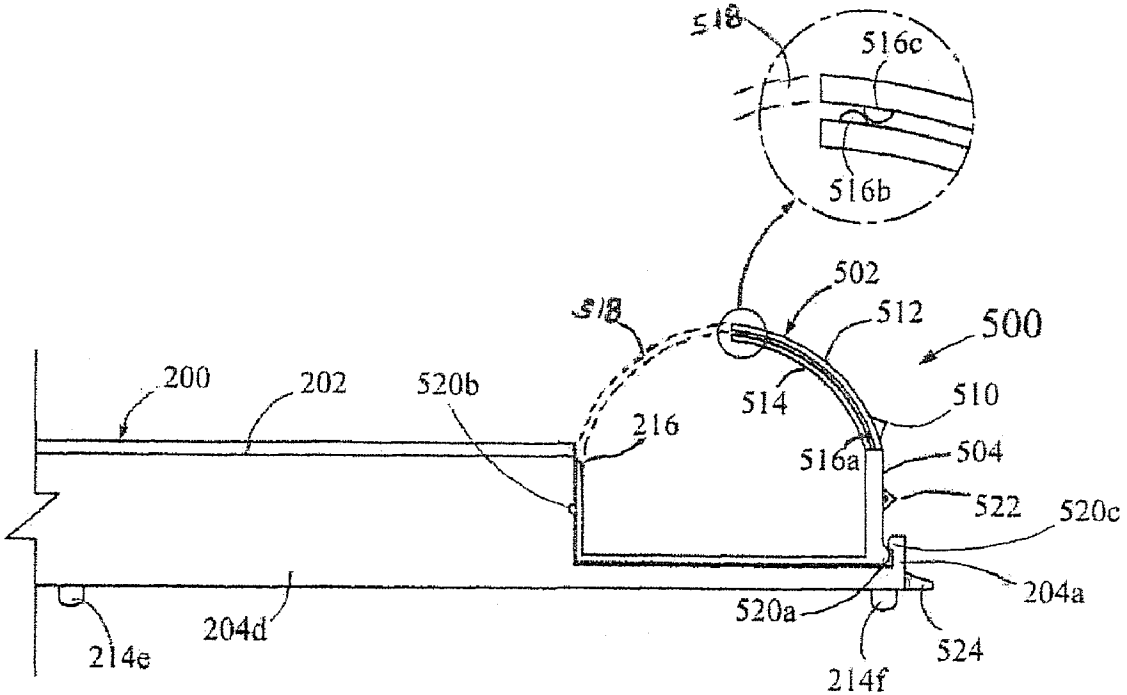
FIGS. 3A and 3B illustrate an open position and a closed position, respectively, of a debris unit of the apparatus of FIG. 1, in accordance with an embodiment of the present disclosure.
Figure 3B:
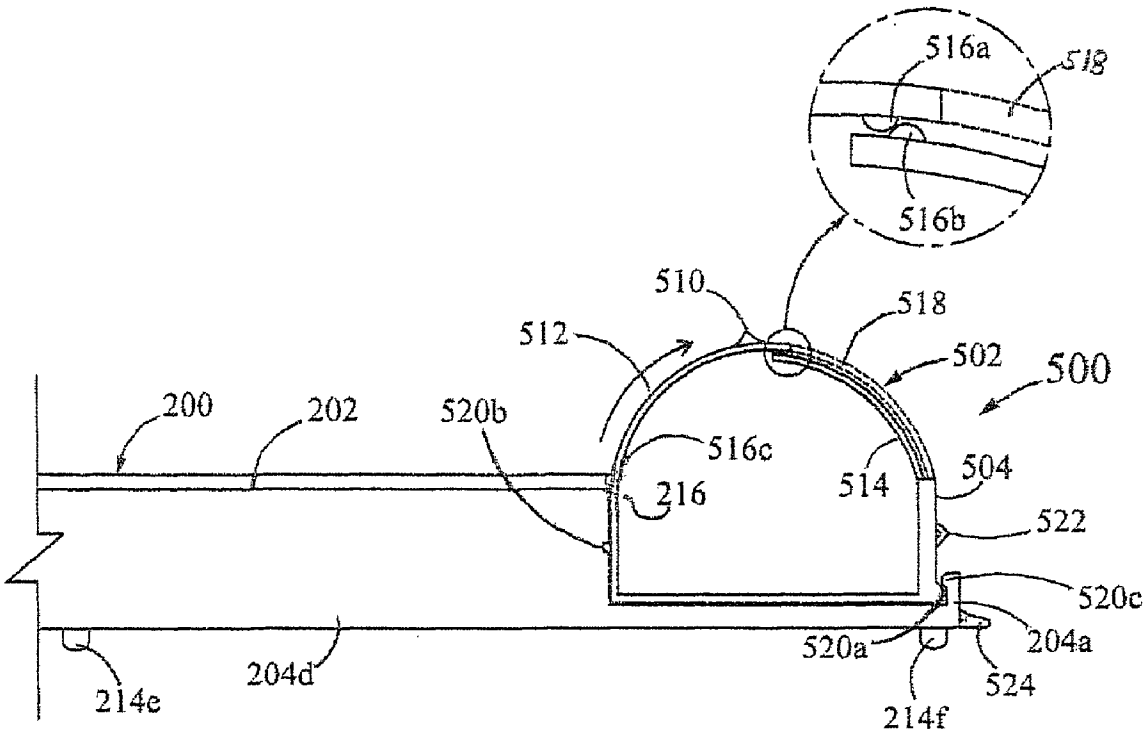

FIGS. 3A and 3B illustrate side views of an open position and a closed position, respectively, of the debris unit 500 of the apparatus 100 of FIG. 1, in accordance with an embodiment of the present disclosure. Referring to FIG. 3A, a side view of the debris unit 500 with the door 502 in the open position, is depicted. The door 502 of the debris unit 500 includes a movable portion 512 and an immovable portion 514. The movable portion 512 of the door 502 is capable of being moved between the open position of the door 502 and the closed position (shown in FIG. 3B) of the door 502. Specifically, a plurality of locking ridges, such as a first locking ridge 516*a*, a second locking ridge 516*b* and a third locking ridge 516*c* (hereinafter collectively referred to as 'locking ridges 516') and a door slot 518 are configured on the debris unit 500 to form a sliding mechanism.

The sliding mechanism enables the movable portion 512 of the door 502 to be slid between the open position and the closed position. The first locking ridge 516*a* and the third locking ridge 516*c* are configured on the movable portion 512 of the door 502 and the second locking ridge 516*b* is configured on the immovable portion 514 of the door 502. The first locking ridge 516*a* and the second locking ridge 516*b* are configured to enable the door 502 of the debris unit 500 to be locked in the closed position. Further, the third locking ridge 516*c* and the second locking ridge 516*b* are configured to enable the door 502 of the debris unit 500 to be locked in the open position. In an embodiment of the present disclosure, the locking ridges 516 may be located throughout a length of the door 502. In another embodiment of the present disclosure, the locking ridges 516 may be located at the center portion of the door 502 and may have a length of about 0.5 inches. However, it will be apparent to a person skilled in the art that, the locking ridges 516 may vary in length. Further, though the locking ridges 516 are used to retain the door 502 in the open position and the closed position, any other retention mechanism known in the art may be utilized for retaining the door 502 in the open position and the closed position.

The movable portion 512 of the door 502 includes the first grip 510 for enabling a user to slide the door 502 between the open position and the closed position. The user may hold the first grip 510 and slide the movable portion 512 of the door 502 in the door slot 518 that is configured above the immovable portion 514 of the door 502. Specifically, the user may apply sufficient force on the first grip 510 (when the door 502 is in the closed position, depicted in FIG. 3B) to enable the first locking ridge 516*a* on the movable portion 512 of the door 502 to slip over the second locking ridge 516*b* on the immovable portion 514 of the door 502. Thereafter, the movable portion 512 of the door 502 may be slid into the door slot 518 to configure the door 502 in the open position. Further, the user may apply sufficient force on the first grip 510 to enable the third locking ridge 516*c* to slip over the over the second locking ridge 516*b* for locking the movable portion 512 of the door 502 in the open position. For the purpose of clarifying the open position of the door 502, the second locking ridge 516*b* and the third locking ridge 516*c* are projected, as shown in FIG. 3A.

In the open position, the debris unit 500 is capable of receiving debris formed by scratching the scratch-off coating 602 from the paper 600, as explained in FIG. 1. The user may clear off the debris that may remain on the base 202 of the panel 200, with the brush and scratch tool combination 400. The user may clear off the debris into the debris unit 500 with the door 502 in the open position. Thereafter, the door 502 may be moved back to the closed position by sliding the movable portion 512 of the door 502. Specifically, the user may apply sufficient force on the first grip 510 to enable the first locking ridge 516*a* to slip over the second locking ridge 516*b*. For the purpose of clarifying the closed position of the door 502, the first locking ridge 516*a* and the second locking ridge 516*b* are projected, as shown in FIG. 3B. In an embodiment of the present disclosure, the first grip 510 may be a thumb grip that is designed to be operable by the user by applying the force through the user's thumb. In another embodiment of the present disclosure, the base 202 of the panel 200 may be configured with a sloping edge 216 that slopes towards the debris unit 500, as depicted. The sloping edge 216 enables the user to clear off the debris from the paper 600 when the debris unit 500 is in the closed position.

Further, the debris unit 500 may be removably coupled to the first wall 204*a* of the panel 200 by a snap-fit attachment. Specifically, the housing 504 of the debris unit 500 includes a protrusion 520*a* and a locking pin 520*b* to form the snap-fit attachment for enabling the debris unit 500 to be detached from the first wall 204*a*. The protrusion 520*a* and the locking pin 520*b* are configured on the housing 504 of the debris unit 500, as depicted in FIGS. 3A and 3B. The panel 200 is configured to accommodate the protrusion 520*a* and the locking pin 520*b* therewithin, as depicted. The first wall 204*a* of the panel 200 may be configured with a locking snap 520*c* to lock the debris unit 500 as shown in FIGS. 3A and 3B.

The debris unit 500 may be coupled to the first wall 204*a* by fitting the locking pin 520*b* in the panel 200. Thereafter, a downward force may be applied on the debris unit 500 by the user to enable the protrusion 520*a* to slide over the locking snap 520*c*. The housing 504 of the debris unit 500 may include a second grip 522 (as depicted) to enable the user to apply the downward force on the debris unit 500 for coupling the debris unit 500 to the first wall 204*a*. Further, the second grip 522 may enable the user to apply an upward force on the debris unit 500 for removing the debris unit 500 from the first wall 204*a*. In an embodiment of the present disclosure, the second grip 522 may be a thumb grip that may enable the user to apply the upward force or the downward force through the user's thumb. The housing 504 of the debris unit 500 may further include a third grip 524 that may enable the user to couple/detach the debris unit 500 to/from the first wall 204*a*.

The second grip 522 may be configured along a length of the housing 504. Alternatively, the second grip 522 may be configured at end portions of the housing 504. In an embodiment of the present disclosure, the second grip 522 may have a length of about 2 inches. However, it will be apparent to a person skilled in the art that the second grip 522 may vary in length. Further, it will be apparent to a person skilled in the art that, any other means known in the art may be utilized for removably coupling the debris unit 500 with the first wall 204*a*.

In use, the user may accommodate the paper 600 within the enclosed area 206 of the panel 200. Thereafter, the user may open the door 502 of the debris unit 500 by moving the movable portion 512 of the door 502 in the open position. Thereafter, the user may scratch the scratch-off coating 602 from the paper 600 by utilizing the scratch tool 300 of the one or more scratch tools. The scratching of the scratch-off coating 602 forms the debris. The debris formed may be swept by the user, using the brush and scratch tool combination 400, into the debris unit 500. The user may close the door 502 of the debris unit 500 by sliding the movable portion 512 of the door 502 in the closed position. To remove the debris from the debris unit 500, the debris unit 500 may be detached from the first wall 204*a* by applying the upward force on the second grip 522. Thereafter, the disposal lid 506 may be uncoupled from the housing 504 of the debris unit 500, and the debris may be disposed. Thereafter, the disposal lid 506 may be coupled with the housing 504 of the debris unit 500. Further, the debris unit 500 may be coupled with the first wall 204*a* of the panel 200.

Figure 4A:
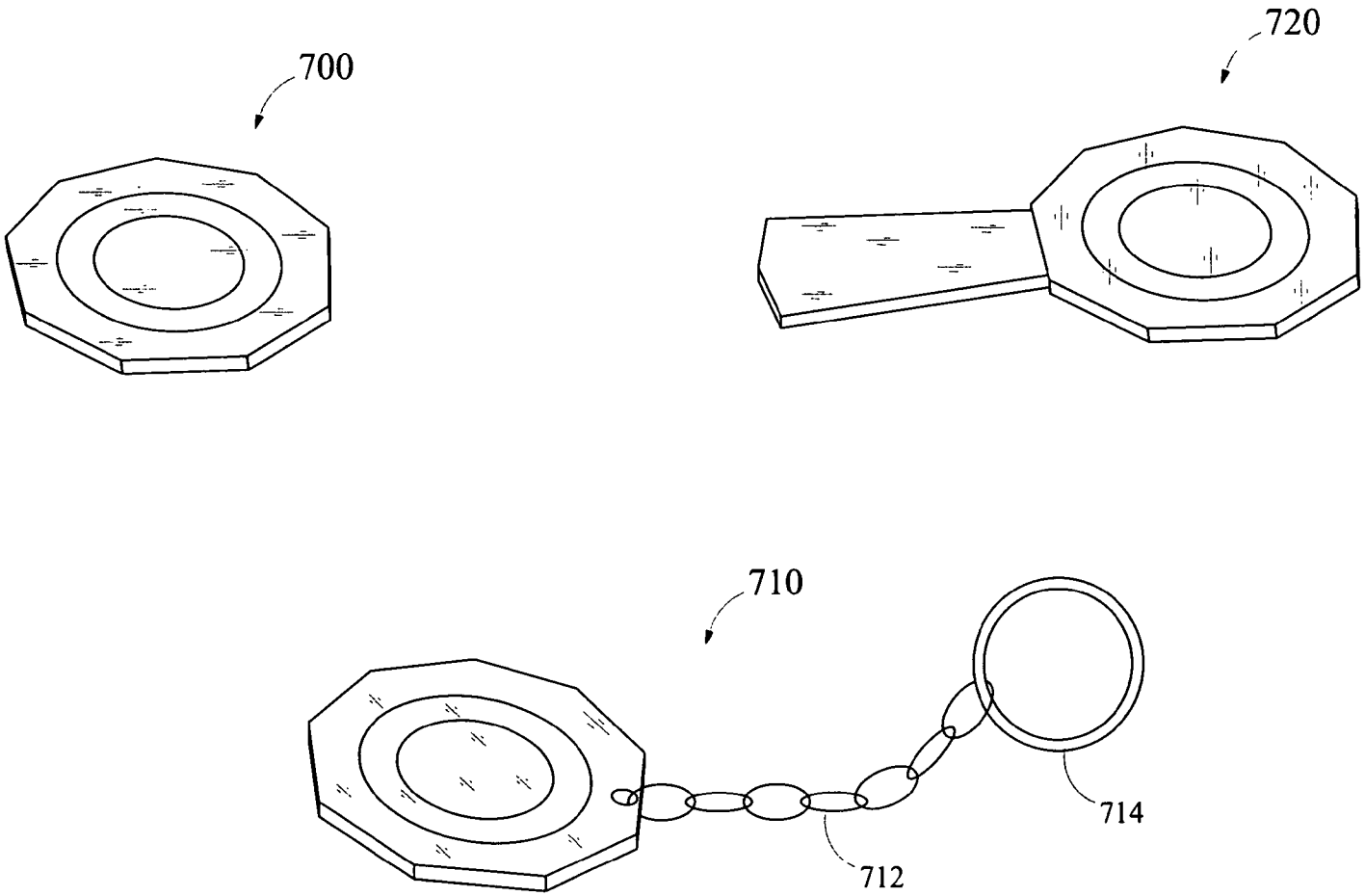
FIGS. 4A and 4B illustrate one or more scratch tools of the apparatus of FIG. 1, in accordance with different embodiments of the present disclosure.
Figure 4B:
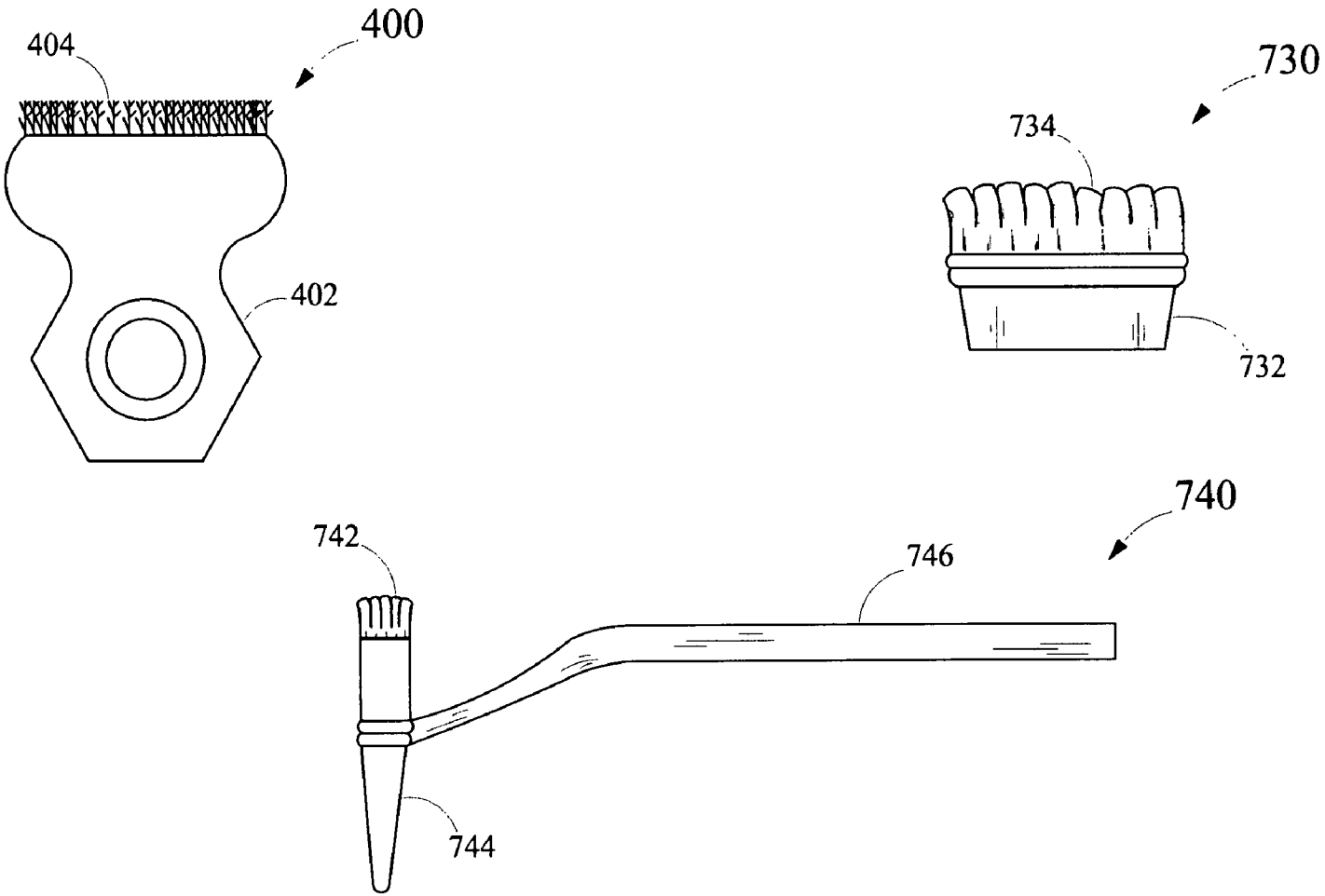

FIGS. 4A and 4B illustrate the one or more scratch tools, in accordance with different embodiments of the present disclosure. FIG. 4A illustrates a coin 700 that may be used as a scratch tool of the one or more scratch tools. In an embodiment of the present disclosure, the coin 700 may be configured with smooth flat edges. In another embodiment of the present disclosure, edges of the coin 700 may be configured with angled grooves. In yet another embodiment of the present disclosure, the one or more scratch tools may be a plurality of coins of varying sizes. The plurality of coins may be of different dimensions to accommodate user preferences. Further, each coin of the plurality of coins may include advertisements, logos, phrases, and the like, printed thereon.

In another embodiment of the present disclosure, the one or more scratch tools may include a plurality of key chains, such as a key chain 710, as depicted in FIG. 4A. The key chain 710 may have flat edges of varying sizes. The flat edges may be smooth or may be configured with angled grooves. In an embodiment of the present disclosure, each edge of the key chain 710 may be 0.25 inches in length. In another embodiment of the present disclosure, the each edge of the key chain 710 may be 0.375 inches in length. In yet another embodiment of the present disclosure, a thickness of the each edge of the key chain 710 may be 0.0625 inches. Further, the key chain 710 includes a plurality of links, such as a link 712, and a ring 714. In an embodiment of the present disclosure, a diameter of the ring 714 may be 1 inch. Furthermore, the key chain 710 may include advertisements, logos, phrases and the like, printed thereon. For example, the key chain 710 may have a logo that resembles a shinny, gold-colored dollar sign.

In yet another embodiment of the present disclosure, the one or more scratch tools may include a plurality of scratch keys, such as a scratch key 720, as depicted in FIG. 4A, that may vary in size. In an embodiment of the present disclosure, the scratch key 720 may be configured with smooth flat edges. In another embodiment of the present disclosure, edges of the scratch key 720 may be configured with angled grooves.

In still another embodiment of the present disclosure, the one or more scratch tools may be a brush and scratch tool combination, such as a brush and scratch tool combination 400 and a brush and scratch tool combination 730, as illustrated in FIG. 4B. The brush and scratch tool combination 400 includes a blade 402 and a plurality of bristles 404. The blade 402 may be utilized to scratch the scratch-off coating 602 from the paper 600. Further, the plurality of bristles 404 may be utilized to sweep the debris formed by scratching the scratch-off coating 602 from the paper 600. In an embodiment of the present disclosure, the blade 402 may be configured with smooth flat edges. In another embodiment of the present disclosure, edges of the blade 402 may be configured with angled grooves. Similarly, the brush and scratch tool combination 730 includes a blade 732 and a brush 734. The blade 732 may have a width of about 0.5 inches. In yet another embodiment of the present disclosure, a scratch tool and brush 740 may be provided with the apparatus 100. The scratch tool and brush 740 includes a brush 742, a blade 744 and a handle 746. A user may utilize the scratch tool and brush 740 by gripping the handle 746.

It will be apparent to a person skilled in the art that various combinations of embodiments as described in the present disclosure may exist.

An apparatus, such as the apparatus 100, for scratching and disposing a scratch-off coating that conceals information on a paper, offers the following advantages. A debris unit, such as the debris unit 500, of the apparatus enables disposal of debris formed by scratching the scratch-off coating. Further, a panel, such as the panel 200, of the apparatus provides a space for accommodating the paper, to enable a user to scratch the scratch-off coating, with ease. Furthermore, a scratch tool, such as the scratch tool 300, is provided with the apparatus to ease availability of the scratch tool for the user, when required. Still further, a brush provided with the apparatus precludes the user from using his hands for clearing off the debris.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present disclosure.

What is claimed is:

1. An apparatus for scratching and disposing a scratch-off coating, the scratch-off coating concealing information on a paper, the apparatus comprising:

a panel comprising a base and a plurality of walls, the plurality of walls configured along a periphery of the base to form an enclosed area therebetween for accommodating the paper;

wherein said panel further comprises a plurality of feet disposed on an underside of the panel, one or more scratch tools for scratching the scratch-off coating from the paper accommodated within the enclosed area of the panel, the one or more scratch tools capable of being contained within the panel, wherein scratching the scratch-off coating forms debris;

a brush for sweeping the debris formed by scratching the scratch-off coating from the paper, the brush capable of being stored when not in use in a slot of a wall of the panel; and a debris unit coupled to a first wall of the plurality of walls of the panel for receiving and containing the debris formed by scratching the scratch-off coating wherein the debris unit comprises a housing and a door, the housing capable of receiving and containing the debris, the door coupled to the housing, and a movable portion of the door capable of being moved between an open position and a closed position, wherein the door comprises a curved door formed from a fixed arcuate portion that extends upwardly from a wall of the plurality of walls of the panel and from a movable arcuate portion that is disposed above the fixed arcuate portion and that may move away from the wall of the plurality of walls from which the fixed arcuate portion extends upwardly toward the base of the panel to selectively close the debris unit, and wherein the fixed arcuate portion and movable arcuate portion comprise engagement features for at least temporarily securing the door in a closed position.

2. The apparatus of claim 1, wherein a second wall of the plurality of walls comprises an extension, the extension extending towards the enclosed area of the panel, the extension configured to grip a portion of the paper accommodated within the enclosed area of the panel.

3. The apparatus of claim a 1, further comprising a sliding mechanism configured on the debris unit, the sliding mechanism enabling the movable portion of the door to be slid between the open position and the closed position.

4. The apparatus of claim 3, wherein the movable portion of the door comprises a first grip, the first grip configured to enable sliding of the movable portion of the door between the open position and the closed position.

5. The apparatus of claim a 1, wherein the debris unit is capable of receiving the debris when the movable portion of the door is in the open position, and wherein the debris unit contains the debris when the movable portion of the door is in the closed position.

6. The apparatus of claim 1, wherein the debris unit further comprises a disposal lid, the disposal lid configured on the housing of the debris unit for enabling removal of contained debris from the debris unit.

7. The apparatus of claim 1, wherein a scratch tool of the one or more scratch tools is a coin.

8. The apparatus of claim 1, wherein the debris unit is removably coupled to the first wall of the plurality of walls of the panel by a snap-fit attachment.

9. The apparatus of claim 8, wherein the housing of the debris unit comprises a second grip, the second grip configured to enable coupling and removal of the debris unit from the first wall of the plurality of walls of the panel.

10. The apparatus of claim 1, wherein the paper is one of a lottery ticket and a card.

* * * * *